US008397840B2

(12) United States Patent
Downie et al.

(10) Patent No.: US 8,397,840 B2
(45) Date of Patent: Mar. 19, 2013

(54) REPLACEABLE WEAR BAND FOR WELL DRILL PIPE

(75) Inventors: Joseph A. Downie, Aliquippa, PA (US); Bruce M. Warnes, Beaver, PA (US)

(73) Assignee: Reusable Wearbands, LLC, Beaver, PA (US)

( * ) Notice: Subject to any disclaimer, the term of this patent is extended or adjusted under 35 U.S.C. 154(b) by 0 days.

(21) Appl. No.: 13/363,416

(22) Filed: Feb. 1, 2012

(65) Prior Publication Data

US 2013/0000990 A1 Jan. 3, 2013

Related U.S. Application Data

(60) Provisional application No. 61/438,891, filed on Feb. 2, 2011, provisional application No. 61/592,684, filed on Jan. 31, 2012.

(51) Int. Cl.
*E21B 17/10* (2006.01)

(52) U.S. Cl. ..... 175/325.5; 166/242.6; 285/223

(58) Field of Classification Search ..... 175/325.5; 166/378, 241.6, 242.6; 29/505–508; 285/223, 285/235

See application file for complete search history.

(56) References Cited

U.S. PATENT DOCUMENTS

| | | | | |
|---|---|---|---|---|
| 2,671,641 | A * | 3/1954 | Hinkle | 175/325.5 |
| 4,023,835 | A * | 5/1977 | Ewing et al. | 285/235 |
| 4,211,440 | A | 7/1980 | Bergstrom | |
| 4,273,159 | A | 6/1981 | Bolton et al. | |
| 4,616,855 | A | 10/1986 | Ruhle | |
| 4,753,423 | A | 6/1988 | Ukai et al. | |
| 4,846,511 | A * | 7/1989 | Krumscheid | 285/235 |
| 4,923,183 | A | 5/1990 | Saka | |
| 5,147,996 | A | 9/1992 | Carlin | |
| 5,181,668 | A | 1/1993 | Tsuji et al. | |
| 6,474,701 | B1 | 11/2002 | Bowles | |
| 6,817,633 | B2 | 11/2004 | Brill et al. | |
| 6,843,514 | B2 | 1/2005 | Rex et al. | |
| 7,124,826 | B2 | 10/2006 | Simpson | |
| 2008/0190508 | A1 | 8/2008 | Booth et al. | |
| 2009/0174129 | A1 | 7/2009 | Izumida et al. | |
| 2010/0252274 | A1 * | 10/2010 | Buytaert et al. | 166/380 |
| 2010/0263195 | A1 | 10/2010 | Niccolls et al. | |
| 2011/0042069 | A1 * | 2/2011 | Bailey et al. | 166/244.1 |

OTHER PUBLICATIONS

Barber, Gary C., Experimental Study on the Friction Characteristics of Lasertex Steel Sheets During Metal-Forming Process, Tribology and Lubrication Technology, Jul. 2011, pp. 48-53, USA.

* cited by examiner

*Primary Examiner* — Nicole Coy
(74) *Attorney, Agent, or Firm* — McKay & Associates, P.C.

(57) ABSTRACT

A wear band for a well drill pipe which is made up of a coil spring sized to fit at the joint of the well drill pipe or casing. The inner surface of the coil spring includes a textured coating such as a carbide. The outer surface includes a plurality of hydrodynamic dimples defined therein, and preferably both the outer surface and the inner surface are adapted to resist corrosion. The abrasive coating preferably consists essentially of 95% tungsten carbide and a binder of 5% cobalt and coats an amount of the inner surface in the range of 50% to 100%. The hydrodynamic dimples are generally tear drop in shape to act as miniature fluid pumps. As a result, the wear band can be mechanically attached to the drill pipe while eliminating the need for metallurgically-welded hardbands and therefore unaffecting the drill pipe properties and dimensions.

11 Claims, 2 Drawing Sheets

REPLACEABLE WEAR BAND FOR WELL DRILL PIPE

CROSS-REFERENCE TO RELATED APPLICATIONS

The instant application claims benefit of provisional application Ser. No. 61/438,891 filed Feb. 2, 2011 and Ser. No. 61/592,684 filed Jan. 31, 2012, the contents of both of which are incorporated herein by reference.

BACKGROUND

1. Field of the Invention

The present invention relates to bands which decrease the wear around the outside diameter of oil or gas well drill pipes, the joints of which typically have welded hardbands adjacent thereto.

2. Description of the Related Art

The methods for drilling and casing oil and gas wells have evolved considerably in recent years. In particular, the introduction of horizontal drilling tools and techniques, as well as the exploitation of lower yield production zones have placed new demands on oil and gas well service providers responsible for completing wells for production.

No matter what the medium, no matter what the depth and no matter what the technique, all wells involve the installation of casing and, in some cases, sleeving, which results in long segments of joined piping (in some instances three to five thousand feet or more) which is formed by forming joints in much-shorter segments of pipe, usually about thirty (30) feet.

Extended-reach (ERD) and other critical projects exceed the capabilities of conventional steel drillstring assemblies. Alternative materials and advanced technologies are being evaluated to expand the ERD envelope. Titanium has been used, and solutions under development incorporate a new ultra-high-strength steel. Aluminum is also becoming a material of choice. For one, drilling contractors find that aluminum drill pipe can cut their drilling costs, with greater advantage occurring at increasing drilling depths.

While the substitution of aluminum for steel drill pipe can result in operating cost savings, maximum economic gains can be realized by properly matching the aluminum drill pipe with other related drilling project factors, such as hardband selection. Currently, the application of wear bands by welding, thermal spray or laser cladding etc. involves heating and/or melting of the drill pipe surface. Heating the pipe can degrade its' mechanical properties, particularly age-hardened aluminum drill pipe. In addition, these products are metallurgically bonded, and so they can only be removed by cutting them off the drill pipe. Thus, current wear band technology may damage the drill pipe during application, and does damage the pipe when removed.

Accordingly, proper hardband selection, application and maintenance are essential to successfully and safely drilling deep projects. The hardband designer must balance the often-conflicting traits of high hardness to protect the tool joint, low casing wear properties and cracking tendencies. The correct hardband solution can maximize drillstring life by protecting the tool joints from excessive wear, minimize wear of the intermediate casing strings in the well (essential to maintain pressure integrity of the well and ensure a safe operating environment) and reduce the friction coefficient between the drill pipe and the wellbore, which in turn reduces the torque and drag forces acting on the drillstring. Furthermore, although the performance of a particular hardbanding material may be a primary reason for selecting or rejecting a material, there are secondary considerations including but not limited to field experience, availability of application and reapplication, ability to be field-applied in a consistent manner, and cost.

However, even when applying the above factors, wear band/hardband applications are still performed using a welding or thermal spray process. Although the hardband materials can be specially designed to maximize the drillstring life, state of the art wear hands cannot be applied or removed without at least minor damage and/or dimension changes to the drill pipe and significant labor requirements. In the instant invention, this welding is replaced as further described herein.

SUMMARY

It is an objective of the instant invention to provide a wear band for an oil or gas well drill pipe which is mechanically attached to the drill pipe at or near the joint, so there is no heating of the pipe when it is applied and no damage to the pipe when it is removed.

It is further an objective to eliminate drill pipe damage from wear band application and removal.

It is further an objective to provide a wear band which is inexpensive compared to current wear band technology.

It is further an objective to provide a wear band which can he applied at the drill site rather than in a coating or cladding factory.

Accordingly, what is provided is a wear band for a well drill pipe which is made up of a coil spring sized to fit over the well drill pipe, particularly at a joint thereof. The coil spring has a leading end, a trailing end, an outer surface and an inner surface, wherein the inner surface includes a textured coating such as a carbide. The outer surface includes a plurality of hydrodynamic dimples defined therein, and preferably both the outer surface and the inner surface are adapted to resist corrosion. The textured coating consists essentially of 95% tungsten carbide and a binder of 5% cobalt and coats an amount of the inner surface in the range of 50% to 100%, The hydrodynamic dimples are generally tear drop in shape to act as miniature fluid pumps. As a result, the wear band can be mechanically attached to the drill pipe, adjacent to sections thereof while eliminating the need for metallurgically-welded hardbands.

In a method then for protecting wear of the drill pipe, an inner surface of a square wire is coated with the textured coating; a plurality of hydrodynamic dimples are machined into an outer surface of the square wire; the square wire is wound to form a coil spring; and, the coil spring is chemically treated for corrosion resistance. Next, the coil spring is deformed to form an expanded coil. The expanded coil is fitted at a location along the drill pipe and, at this location, the expanded coil is allowed to elastically recover and clamp onto the drill pipe to perform the similar function as a hardband but without metallurgical welds.

DETAILED DESCRIPTION OF THE PREFERRED EMBODIMENT

Figure 1:
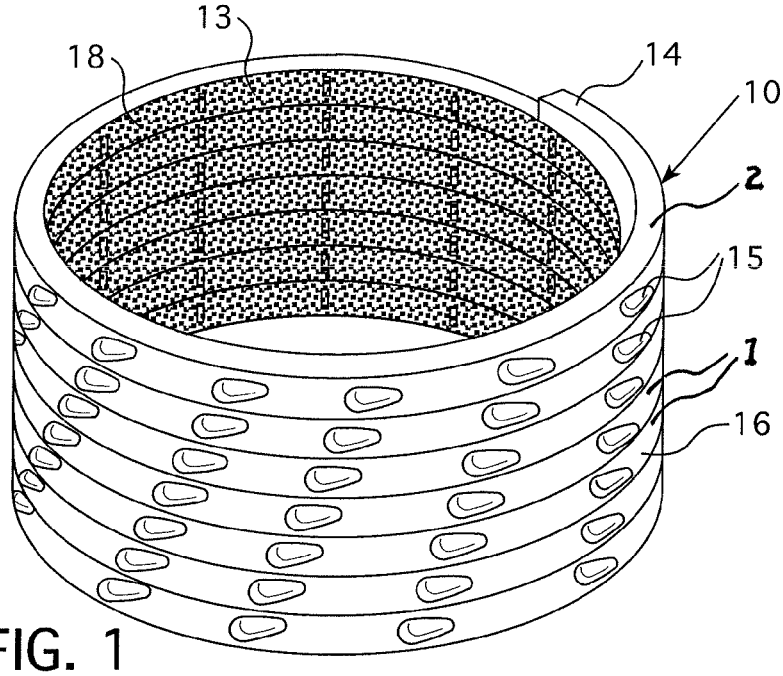
FIG. 1 shows a perspective view of the instant wear band including the inner surface.
Figure 2:
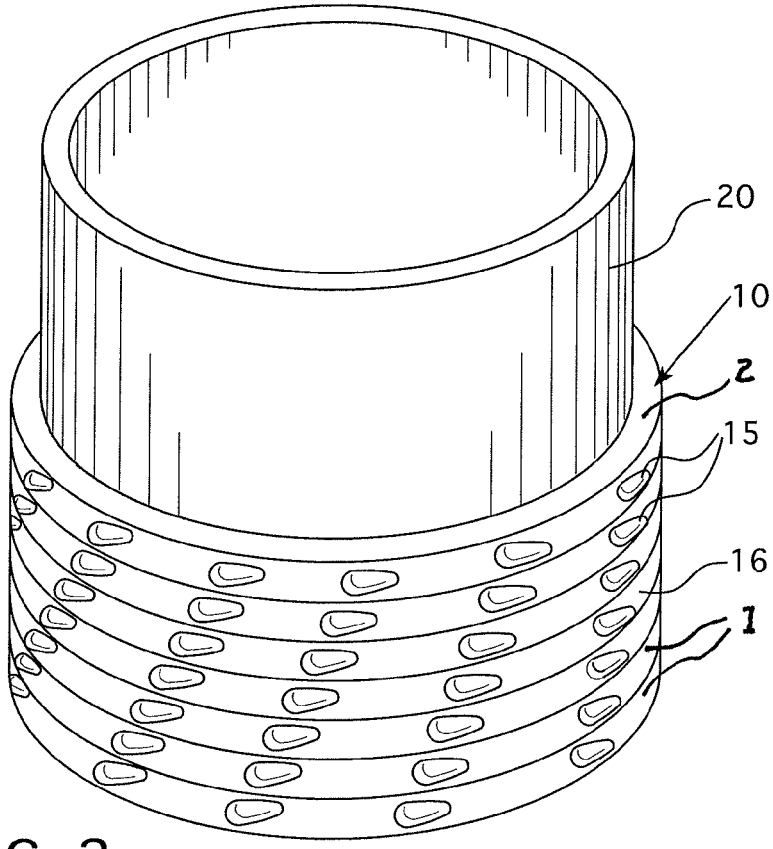
FIG. 2 shows the same perspective view of the instant wear band in use around a pipe.
Figure 3:
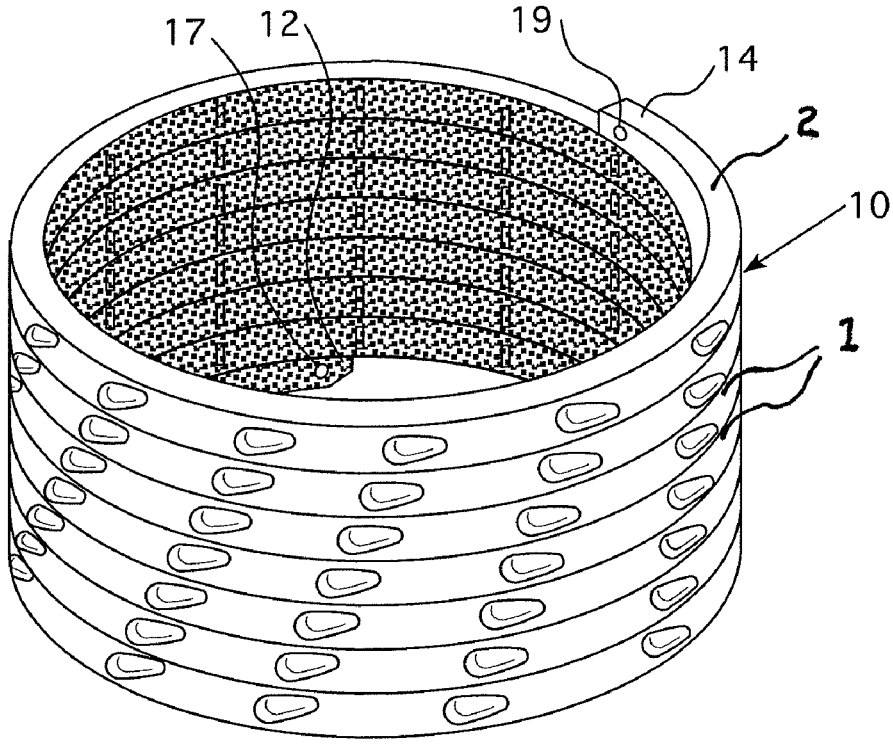
FIG. 3 shows a perspective view of an alternative embodiment of the instant wear band with modified ends.

With reference then to FIGS. 1-3, shown is the instant wear band taking the form of a coil spring 10. The coil spring 10 is sized such that it can slide down onto and fit over a well drill pipe 20 at a joint thereof. "Pipe" as defined herein refers to an individual drill pipe 20 or the joined sections which form parts of or the entirety of the drillstring. It should be understood that the instant coil spring 10 can be used at or near the joint of the pipe 20, within the annulus between the pipe 20 to therefore be subjected to wear instead of the pipe itself. "Pipe" as used in the claims means either the pipe 20 or any cylindrical pipe used in an oil or gas drilling operating or any application other than oil and gas drilling which demands the protection of a cylinder(s) at or near a particular joint or location. Furthermore, when referring to "at" a joint as it relates to the location of the instant coil spring 10, "at" or "location" means directly over the joint or near the joint along the outer diameter (O.D.) of the pipe.

The coil spring 10 has a leading end 12, a trailing end 14, an outer surface 16 and an inner surface 18. The coil spring is coiled to have multiple turns 1 with each turn 1 having at least one face 2 in contact with an adjacent face of an adjacent turn to form an enclosure as shown. The coil spring 10 wear band can be manufactured from a variety of commercially available alloys such as a spring steel alloy, and in the preferred embodiment the spring 10 is made from steel wire. The material of the spring can be changed to increase or decrease spring hardness. The entirety of the coil spring 10 (at a minimum the outer surface 16 and inner surface 18) can be chemically treated to resist corrosion. This can be accomplished with any variety of gas-solid, liquid-solid and solid-solid treatments. A square wire can be made from round wire using a wire drawing machine with opposed rollers through which the round wire is pulled. Although "square" is used herein, the wire in cross-section can be "substantially" square by having slightly rounded corners and/or generally flat surfaces having radii in the range of zero to 1/32".

The spring 10 is wound so that it tends to contract when it rubs on the well casing, which further improves the mechanical bonding of the coil spring 10 to the pipe 20 in service. This occurs because a well drill pipe 20 rotates right hand. However, the spring 10 is wound left hand so friction will tend to tighten the spring 10. One end of the spring 10, the trailing end 14, will be trailing during this contact. The other end is the leading end 12, referring to the end of the coil spring 10 which is bottommost when installed around the pipe, which would be first to catch or stumble on the pipe casing during use if it were to occur. To lessen the likelihood of this, the leading end 12 of the coil spring 20 can he beveled (see FIG. 3).

The inner surface 18 of the coil spring 10 preferably includes a textured coating 13 to increase the coefficient of friction between the coil spring 10 and the pipe 20, ensuring an even more secure attachment of the spring wear band to the pipe 20. Preferably the textured coating 13 covers the entirety of the inner surface 18, but a coating 13 which coats an amount of the inner surface 18 in the range of 50% to 100% is also likely, with any further lessening (down to zero) perhaps desirable for economical reasons provided function is not impacted, in which case the fit and tension of the coil spring 10 would have to largely be relied upon. In the preferred embodiment the textured coating 13 is a carbide. For example, suitable is a metal carbide consisting essentially of tungsten carbide in the range of 90%-98%, preferably 95%, and the remaining composition a binder of cobalt, preferably 5%. The textured coating 13 composition may vary in terms of materials and amount, but important is that the friction between the inner surface 18 and the pipe 20 be enhanced if needed. The resulting dimensions of the textured coating 13 may also vary, for instance the individual metal crystallites can vary in "mesh" size and orientation. Finally, the textured coating 13 application method may vary, selected from the group consisting of knurling, sandblasting, thermal spraying, and electrospark deposition of other carbide rich materials. In the preferred embodiment the textured coating 13 is applied using an electrospark process, i.e. capacitive discharge microwelding. Electrospark deposition (ESD) is the well-known pulsed-arc microwelding process using short-duration, high current electrical pulses to deposit an electrode material on a metallic substrate.

The outer surface 16 of the coil spring wear band preferably includes a plurality of hydrodynamic dimples 15 defined therein. The dimples 15 are indentations stamped or etched into the outer surface 16 using any type of laser-surface texturing process or machining. Although not critical, the hydrodynamic dimples 15 are spaced equally along said coil spring 10, i.e. each dimple 15 is equidistant from an adjacent dimple 15, thereby easing the number of milling steps involved. Of note is that although the dimples are shown aligned in FIG. 1, which the case may be when the wear band is manufactured but not yet in put in use in the field, when the coil spring 10 is applied to the pipe 20 as shown in FIG. 2, although not shown, in all likelihood the dimples 15 become staggered and no longer remain "aligned" in appearance due to the expansion and contraction of the coil spring 10.

Preferably, each hydrodynamic dimple 15 is generally tear drop in shape, "generally" herein defined as non-symmetrical about one axis with a large radial end and a smaller radial end similar to that as shown. Although not critical, a non-symmetrical shape as shown is preferred. Because the pipe 20 rotation is predictable because of right hand threads in the pipe 20 string, non-symmetrical dimples 15 are used to entrain fluid in the large end and compress it as the fluid moves to the smaller exit, thereby increasing fluid pressure. So the dimple 15 is a miniature fluid pump, hence the term "hydrodynamic". The result is a laser-surfaced texture which improves the tribiological characteristics of the coil spring 10, i.e. an improved load capacity, wear rate, lubrication retention, and reduced coefficient of friction along the outer surface 16. Further, independent of shape or depth, the dimples 15 have a level of entrainment capabilities. Third party abrasion involves dirt or wear debris, sand, etc., abrading the working surfaces in relative sliding. If the grit can go to the lower stress pockets it can be taken out of the wear equation. As above, in the instant embodiment the non-symmetrical dimples 15 were formed by laser surface texturing. However, it is also envisioned that any machining process can be used, e.g. while making the wire for the coil spring 10 the rollers could include the shaped-projections for stamping the wire.

FIG. 3 shows an alternative embodiment of the coil spring 10 showing the beveled leading end 12 (shown in FIG. 3 only). Leading end 12 may also be rounded (not shown), so "beveled" encompasses this definition. Also shown is a leading end hole 17 defined proximate to the leading end 12 and a trailing end hole 19 defined proximate to the trailing end 14. As will be further described these holes 17, 19 serve as the grasping point for a tool designed to pull the coil spring 10 apart, thereby increasing its diameter such that the wear band can be placed over the pipe 20.

Therefore, in use and for a method for protecting wear of a drill pipe 20, an inner surface 18 of a square wire having two ends 12, 14 is coating with an textured coating 13. A plurality of hydrodynamic dimples 15 are surface-textured (or machined) into an outer surface 16 of the square wire. Using a mandrel or similar the square wire is wound or turned to form a coil spring 10. The winding and spring formation can occur on-site or remotely. For instance, an installer can fieldwind a new textured band right at the well head. Also, depending on the application and size of the pipe 20 the number of turns may vary (shown are seven (7) turns in this particular embodiment). If the material of the coil spring 10 is not a corrosion resistant material, the coil spring 10 is then chemically treated for corrosion resistance and is ready for placement about the pipe 20. To accomplish this placement the coil spring 10 is deformed to form an expanded coil. For this deformation step, a force is applied to both of the ends (trailing end 12 and leading end 14) to cause an increase in a diameter of the coil spring 10. The force can be applied using any tool which will unwind the coil spring 10 by applying a torsional force to the ends 12, 14 of the coil spring 10 or to the radial holes 17, 19 drilled into coil spring 10. The tools can vary in terms of the drive mechanism used to expand the spring 10, changes in the locking mechanisms once the spring 10 is expanded and the means used to prevent warping of the spring wire during expansion.

In the preferred embodiment, disclosed by U.S. Provisional Application Ser. No. 61/592,684 is a tool specially designed for the instant wear band to mechanically change the state of the coil 10. The mechanical device is designed to apply pressure to both ends 12, 14 of the coil spring 10 causing an increase in its diameter by elastic deformation of the wire. In summary, a worm wheel segment and a worm gear are mounted on a clamshell device that opens and closes around the coil spring 10. With the tool closed around the coil spring 10, rotating the worm gear around its own axis moves the worm segment around the longitudinal axis of the spring and simultaneously a pin connected to the gear segment engages the trailing end hole 19 in the unwinding direction while a pin in the stationary portion of the clamshell reacts against the leading end hole 17 (opposite end of the spring). Using the tool the expanded coil is locked into this deformed state and with its now larger diameter, the expanded coil spring 10 can slide down and be fitted at a location along the drill pipe 20 such as at a joint. When at the desired location, the expanded coil 10 is "unlocked" or released such that the expanded coil 10 elastically recovers and clamps onto the drill pipe 20 forming an enclosure at the joint. As a result, the wear band is now mechanically attached to the drill pipe 20, adjacent to sections thereof while eliminating the need for metallurgically-welded hardbands. Since no heat is applied to the pipe 20 and the wear band is not chemically or physically bonded to the pipe 20, the drill pipe properties and dimensions are unaffected.

EXAMPLE

Used is a nominal 5" pipe having an exact O.D. of 5.147". ⅜ inch square A-229 steel wire is formed from round wire rolled through a turkshead four (4) opposed rollers. 40 mesh Carbinite is applied on the inner surface of the wire by electro spark. Dimples were machined on a standard milling machine using a ball end mill where the ball formed the big end and the side of the end mill made the tail during tangential contact. Wire was wound using a spring winder (Diamond Wire Spring—Pittsburgh, Pa.). The wound spring is 4,906 inside diameter, 5.670 outside diameter, and approximately 3¼" long. After installation the coil spring O.D. becomes 5.945 in.

We claim:

1. A wear band for a well drill pipe, comprising:

a coil spring having multiple turns, each said turn having at least one face in contact with an adjacent face of an adjacent turn, said coil spring sized to fit over and enclose said well drill pipe at a joint thereof, said coil spring having a leading end, a trailing end, an outer surface and an inner surface, wherein said inner surface includes a textured coating, and wherein said outer surface includes a plurality of non-symmetrical, hydrodynamic dimples defined therein.

2. The wear band of claim 1, wherein both said outer surface and said inner surface are adapted to resist corrosion.

3. The wear band of claim 1, wherein said coil spring consists of steel wire substantially square in cross-section.

4. The wear band of claim 1, wherein said textured coating is a carbide.

5. The wear band of claim 4, wherein said carbide is a metal carbide consisting essentially of 95% tungsten carbide and a binder of 5% cobalt.

6. The wear band of claim 5, wherein said textured coating coats an amount of said inner surface in the range of 50% to 100%.

7. The wear band of claim 1, wherein each said hydrodynamic dimple is spaced equally along said coil spring from an adjacent one of said hydrodynamic dimples.

8. The wear band of claim 1, wherein each said hydrodynamic dimple is generally tear drop in shape.

9. The wear band of claim 1, wherein said coil spring is wound such that said coil spring is adapted to contract when it is wrapped around said well drill pipe and rubs on casing.

10. The wear band of claim 1, wherein said leading end is beveled.

11. The wear band of claim 1, further comprising a leading end hole defined through said coil spring proximate to said leading end and a trailing end hole defined through said coil spring proximate to said trailing end.

* * * * *